US007384446B2

(12) United States Patent
Unami et al.

(10) Patent No.: US 7,384,446 B2
(45) Date of Patent: Jun. 10, 2008

(54) MIXED POWDER FOR POWDER METALLURGY

(75) Inventors: Shigeru Unami, Chiba (JP); Satoshi Uenosono, Chiba (JP); Yukiko Ozaki, Chiba (JP)

(73) Assignee: JFE Steel Corporation, Tokyo (JP)

( * ) Notice: Subject to any disclaimer, the term of this patent is extended or adjusted under 35 U.S.C. 154(b) by 71 days.

(21) Appl. No.: 10/560,080

(22) PCT Filed: Apr. 21, 2005

(86) PCT No.: PCT/JP2005/008092

§ 371 (c)(1),
(2), (4) Date: Dec. 8, 2005

(87) PCT Pub. No.: WO2005/102564

PCT Pub. Date: Nov. 3, 2005

(65) Prior Publication Data

US 2007/0089562 A1 Apr. 26, 2007

(30) Foreign Application Priority Data

Apr. 22, 2004 (JP) ..... 2004-126656
Feb. 15, 2005 (JP) ..... 2005-037069

(51) Int. Cl.
*B22F 1/02* (2006.01)

(52) U.S. Cl. ..... 75/252; 75/255

(58) Field of Classification Search ..... 75/255, 75/252, 246
See application file for complete search history.

(56) References Cited

U.S. PATENT DOCUMENTS 4,702,772 A * 10/1987 Engstrom et al. ..... 75/243
5,308,702 A * 5/1994 Furukimi et al. ..... 428/403
5,571,305 A * 11/1996 Uenosono et al. ..... 75/246
5,605,559 A * 2/1997 Unami et al. ..... 75/255
6,068,813 A * 5/2000 Semel ..... 419/66
6,652,618 B1 * 11/2003 Unami et al. ..... 75/252

FOREIGN PATENT DOCUMENTS

| | | | |
|---|---|---|---|
| EP | 1 184 107 | A1 | 3/2002 |
| JP | 50-10246 | B | 4/1975 |
| JP | 59-215401 | A | 12/1984 |
| JP | 63-137102 | * | 6/1988 |
| JP | 63-66362 | B2 | 12/1988 |
| JP | 6-81001 | A | 3/1994 |
| JP | 6-89365 | B2 | 11/1994 |
| JP | 7-51721 | B2 | 6/1995 |
| JP | 7-233401 | A | 9/1995 |
| JP | 8-49047 | A | 2/1996 |
| JP | 2000-064001 | A | 2/2000 |
| JP | 2003-147405 | A | 5/2003 |
| JP | 2003-247003 | A | 9/2003 |

* cited by examiner

*Primary Examiner*—Roy King
*Assistant Examiner*—Ngoclan T. Mai
(74) *Attorney, Agent, or Firm*—Frishauf, Holtz, Goodman & Chick, P.C.

(57) ABSTRACT

Mo of 0.05 to 1.0% by mass is adhered to the surfaces of an iron-based powder containing Mn of 0.5% by mass or less and Mo of 0.2 to 1.5% by mass as prealloyed elements by diffusion bonding, whereby an alloy steel powder is formed. Furthermore, a Ni powder of 0.2 to 5% by mass and/or a Cu powder of 0.2 to 3% by mass are added to the alloy steel powder, whereby a mixed powder for powder metallurgy is formed. The mixed powder for powder metallurgy according to the present invention enables production of sintered bodies having high density as well as superior tensile strength and rotating bending fatigue strength.

9 Claims, 1 Drawing Sheet

MIXED POWDER FOR POWDER METALLURGY

This application is the United States national phase application of International Application PCT/JP2005/008092 filed Apr. 21, 2005.

TECHNICAL FIELD

The present invention relates to a mixed powder for powder metallurgy containing an alloy steel powder as its principal component. In particular, the present invention relates to a mixed powder for powder metallurgy suitably used in producing various kinds of sintered metal components which require superior strength.

BACKGROUND ART

Powder metallurgy technology allows production of components which require high dimensional accuracy and have a complex structure in a shape markedly close to that of the finished product (in near net shape), thereby significantly decreasing the finishing cost. Therefore, many products produced by powder metallurgy are used as various components for machines and apparatuses in many fields.

In general, iron-based green compacts for powder metallurgy (green compacts) are produced as follows. First, an iron-based powder is mixed with alloying powder such as graphite powder and so forth, and lubricant powder such as stearic acid and lithium stearate to prepare an iron-based mixed powder. Then, the iron-based mixed powder is filled in a die, and is subjected to compacting, whereby the iron-based green compact is produced.

The iron-based powders are classified into iron powders (such as pure iron powder), alloy steel powder, and so forth, for example, based upon the components thereof. Also, the iron-based powders are classified into atomized iron powders, reduced iron powders, and so forth, for example, based upon the production method thereof.

In general, the iron-based green compacts are formed with a density of 6.6 to 7.1 $Mg/M^3$. Furthermore, these iron-based green compacts are sintered to form sintered bodies. The sintered bodies are subjected to a sizing or a cutting process according to needs, whereby powder metallurgy products are produced. Furthermore, in some cases, the products are subjected to carburizing-quenching or bright-quenching after sintering for improving tensile strength or fatigue strength thereof.

Recently, iron-based powder metallurgy products with high strength or high fatigue strength are strongly desired due to the development of components with reduced size and weight.

In general, alloying elements (Ni, Cu, Mo, W, V, Co, Nb, Ti, and so forth) are added to the iron-based powders for improving the strength of the powder metallurgy products.

Note that examples of the methods for adding alloying elements include: a method for alloying the iron-based powder with a desired element (prealloying); a method for mixing an alloying powder (powder containing a desired alloying element) and the iron-based powder with or without binder; and a method for holding the mixture of the powder containing an alloying element and the iron-based powder at a high temperature so as to metallurgically combine these powders (diffusion bonding). Various properties of the alloy steel powder (or mixed powder), and various levels of uniformity and diffusion states of the alloying element after sintering are obtained depending on the method. Therefore, it is important to select the alloying element and the addition method for achieving the desired quality of the alloy steel powder (or mixed powder) or the desired quality of the sintered body.

For example, Japanese Examined Patent Application Publication No. 6-89365 discloses an alloy steel powder containing 1.5 to 20% by mass of Mo, which is a ferrite-stabilizing element, as a prealloy. According to the document in the sintering process of the aforementioned alloy steel powder, a single a phase is formed, leading to a high self-diffusion rate with respect to Fe. This accelerates sintering, resulting in a reduced size of the pores contained in the sintered body. Thus, pressure sintering of such an alloy steel powder provides a sintered body with improved densification. Furthermore, such an alloy steel powder contains no alloying element added by diffusion bonding, thereby providing a uniform and stable microstructure. However, the Mo content in the disclosure is relatively high, i.e., 1.8% by mass or more, leading to poor compressibility. This leads to the disadvantage that a green compact cannot be formed with high density (the density of the green compact). Accordingly, the sintered body obtained by performing a general sintering process (i.e., sintering in one step without pressurizing) has a low density, leading to insufficient strength and insufficient fatigue strength.

On the other hand, the pressure sintering method and the two-step sintering method including a repressing step have the disadvantage of high costs. Accordingly, a sintered body is preferably produced with high strength and high fatigue strength without involving such special sintering methods.

On the other hand, Japanese Examined Patent Application Publication No. 7-51721 discloses a steel powder which contains 0.2 to 1.5% by mass of Mo and 0.05 to 0.25% by mass of Mn as prealloyed elements, and which has a relatively high compressibility in compacting. However, it has been revealed by the present inventors that a single a phase is not formed using the aforementioned steel powder due to the Mo content of 1.5% by mass or less. Accordingly, the enhanced sintering between particles is not accelerated in a sintering step at a temperature (1120 to 1140° C.) of a mesh belt furnace generally used for powder metallurgy, leading to a problem of low strength of the sintering neck.

While the Japanese Examined Patent Application Publication No. 7-51721 discloses an iron powder as a comparative example, which contains Ni (3.8% by mass), Mo (0.5% by mass), and Cu (1.4% by mass) by diffusion bonding, the Patent document describes that the iron powder has poorer strength than that of the aforementioned alloy steel powder disclosed as an invention in the Patent document.

On the other hand, Japanese Examined Patent Application Publication No. 63-66362 discloses a technique in which Mo is added to an iron powder as a prealloyed element so long as compressibility is not impaired (Mo: 0.1 to 1.0% by mass), and Cu and Ni are bonded on the surfaces of the iron particles in the form of a powder by diffusion bonding. This technique provides both preferable compressibility during the compacting and high strength after sintering. However, the aforementioned technique has a limited ability to improve tensile strength and fatigue strength by adding Cu and Ni since the iron powder containing Mo as a prealloyed element cannot be sintered sufficiently, as with the technique disclosed in the Japanese Examined Patent Application Publication No. 7-51721.

On the other hand, Japanese Unexamined Patent Application Publication No. 8-49047 discloses an alloy steel powder limiting Mn content to 0.3% or less by mass as a prealloyed element as well as containing Mo of 0.1 to 6.0% by mass and V of 0.05 to 2.0% by mass (as prealloyed elements). The aforementioned alloy steel powder provides a sintered body with high strength after heat treatment while maintaining the compressibility thereof. Also, the patent document discloses that the alloy steel powder may contain one or more kinds of elements of Mo (4% by mass or less); Cu (4% by mass or less); Ni (10% by mass or less); Co (4% by mass or less); and W (4% by mass or less) in the form of powders by mixture or diffusion bonding.

On the other hand, Japanese Unexamined Patent Application Publication No. 7-233401 discloses an atomized iron powder (alloy steel powder) which contains Mn of 0.03 to 0.5% by mass and Cr of 0.03 to less than 0.1% by mass as prealloyed elements. The aforementioned atomized iron powder having excellent machinability of the sintered body, as well as providing superior dimensional-accuracy thereof. Also, the aforementioned Patent document discloses examples of strengthening elements that can be used as prealloyed elements, which include: Ni (4.0% by mass or less); Mo (4.0% by mass or less); Nb (0.05% by mass or less); and V (0.5% by mass or less). Furthermore, the Patent document discloses examples of strengthening elements (alloy powders) that can be added by diffusion bonding, which include: a Ni powder (5.0% by mass or less); a Mo powder (3.0% by mass or less); and a Cu powder (5.0% by mass or less).

However, according to the aforementioned techniques, such alloys are not designed from the perspective of the fatigue strength of components produced by sintering. This leads to difficulty in producing sintered metal components which satisfy the high fatigue strength desired in recent years, using a general sintering step.

For example, Japanese Unexamined Patent Application Publication No. 6-81001 and Japanese Unexamined Patent Application Publication No. 2003-147405 disclose alloy steel powders designed for improving the fatigue strength.

The Japanese Unexamined Patent Application Publication No. 2003-147405 discloses an alloy steel powder in which 0.5 to 1.5% by mass of Mo is bonded on the surfaces of a steel powder containing Ni of 0.5 to 2.5% by mass and Mo of 0.3 to 2.5% by mass as prealloyed elements by diffusion bonding. The aforementioned Patent document also discloses that a sintered body formed of the aforementioned alloy steel powder exhibits superior rolling contact fatigue strength after carburizing-quenching.

On the other hand, the Japanese Unexamined Patent Application Publication No. 6-81001 discloses an alloy steel powder in which Ni (0.5 to 5% by mass) and/or Cu (0.5 to 2.5% by mass) are bonded to an iron-based powder containing Mo of 0.05 to 2.5% by mass and at least one element of V, Ti, and Nb as prealloyed elements by diffusion bonding. The aforementioned Patent document discloses that the alloy steel powder provides a sintered body having superior rolling contact fatigue strength after carburizing-quenching, as well.

DISCLOSURE OF INVENTION

[Problems to be Solved by the Invention]

However, the present inventors have revealed that the alloy steel powders disclosed in the Japanese Unexamined Patent Application Publication No. 6-81001 and the Japanese Unexamined Patent Application Publication No. 2003-147405 do not provide a sintered body having sufficient fatigue strength (rotating bending fatigue strength).

It is an object of the present invention to provide a mixed powder for powder metallurgy formed of an alloy steel powder as a principal component, and particularly to provide a mixed powder for powder metallurgy which provides a sintered body having improved fatigue strength as well as improved tensile strength while maintaining high density of the sintered body without requiring a special sintering process.

[Means for Solving the Problems]

According to an aspect of the present invention, a mixed powder for powder metallurgy comprises an alloy steel powder having: an iron-based powder containing Mn of 0.5% by mass or less and Mo of 0.2 to 1.5% by mass as prealloyed elements; and Mo of 0.05 to 1.0% by mass adhered to the surfaces of the iron-based powder in the form of a powder by diffusion bonding, and a blended powder which is at least one of a Ni powder of 0.2 to 5% by mass and a Cu powder of 0.2 to 3% by mass.

According to another aspect of the present invention, a mixed powder for powder metallurgy comprises an alloy steel powder and a blended powder which is at least one of a Ni powder of 0.2 to 5% by mass and a Cu powder of 0.2 to 3% by mass. Here, the alloy steel powder has the area on the surfaces thereof, which has a Mo concentration of 2.0% or more by mass, in a range equal to or greater than 1% and equal to or less than 30% of the cross-sectional area thereof. On the other hand, the remainder of the alloy steel powder contains Mo with a concentration equal to or greater than 0.2% by mass and less than 2.0% by mass.

Note that according to the present invention, the alloy steel powder preferably includes at least one of the Ni powder and the Cu powder adhered to the surfaces thereof using a binder.

REFERENCE NUMERALS

1: iron-based powder
2: Mo-containing alloy steel powder (metallic Mo powder may be employed)
3: boundary where the iron-based powder and the Mo-containing alloy powder come in contact with each other
4: alloy steel powder

BEST MODE FOR CARRYING OUT THE INVENTION

Detailed description will be made below regarding a mixed powder for powder metallurgy (i.e., powder obtained by mixing an alloy steel powder with a Ni powder and/or a Cu powder) with reference to the drawings.

First, description will be made regarding the alloy steel powder.

Figure 1:
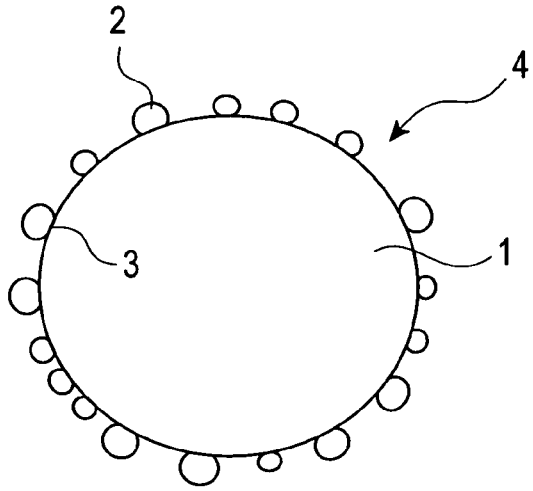
FIG. 1 is a schematic cross-sectional diagram which shows an example of a alloy steel powder used for a mixed powder for powder metallurgy according to the present invention.

As shown in the schematic diagram in FIG. 1, a particle of an alloy steel powder 4 employed as a mixed powder for powder metallurgy according to the present invention has a structure as follows. That is to say, a part of the Mo content contained in a Mo-containing alloy powder 2 (metallic Mo powder may be employed) is diffused into the iron-based powder 1, and is bonded (diffusion bonding) to the surface of the particle of the iron-based powder 1 at the boundary 3.

Next, description will be made regarding an example of manufacturing methods for the alloy steel powder for powder metallurgy according to the present invention.

Figure 2:
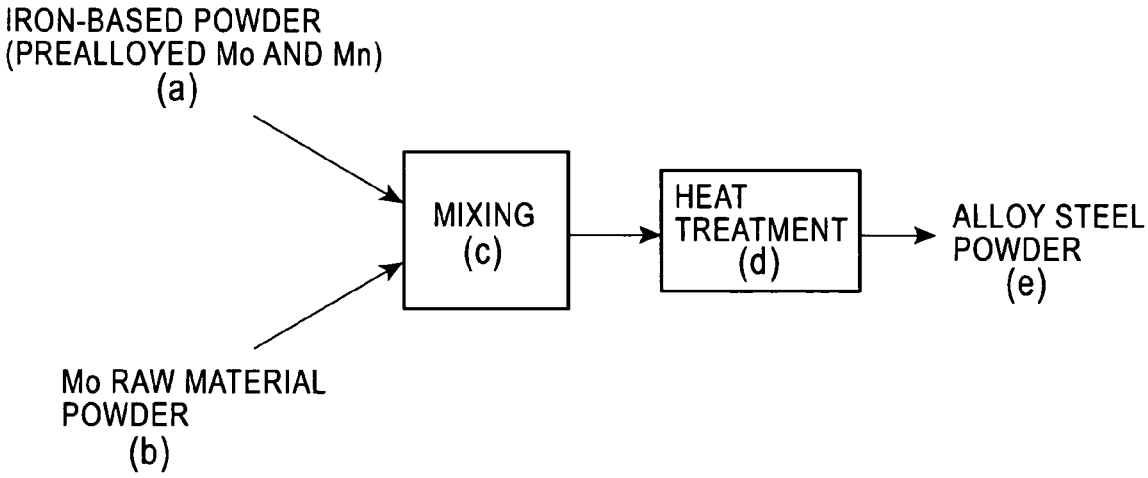
FIG. 2 is a block diagram which shows an example of a production process for the alloy steel powder used for the mixed powder for powder metallurgy according to the present invention.

In the manufacturing process for the alloy steel powder, first, (a) an iron-based powder (raw material) containing predetermined amounts of Mo and Mn as alloying components beforehand (i.e., as prealloying elements) and (b) Mo raw material powder serving as a Mo-containing alloy powder are prepared as shown in an example of the manufacturing process shown in FIG. 2 (block diagram).

As the iron-based powder (a), an atomized iron powder is preferably employed. The atomized iron powder is produced by atomizing molten steel containing predetermined amounts of desired alloy components with water or gas. In general, the atomized iron powder is heated after atomization in a reducing atmosphere (e.g., in a hydrogen atmosphere) to reduce C and O contained therein. However, an atomized iron powder without such heat treatment, i.e., "as atomized" powder, may be employed as the iron-based powder (a) according to the present invention.

Furthermore, a reduced iron powder, an electrolytic iron powder, a crushed iron powder, and so forth may be employed without difficulty so long as the compositions are matched.

Examples of raw materials employed as the aforementioned Mo raw powder (b) include: a metallic Mo powder; a Mo-containing alloy powder; and a Mo-containing compound that can form a Mo-containing alloy powder by reduction. Note that each of the raw materials preferably substantially includes no metallic element except for Mo and Fe.

As the Mo-containing alloy powder, a pure Mo metal powder or a powder formed from commercially available ferromolybdenum may be employed. Also, examples of the raw materials suitably employed include a powder obtained by atomizing an Fe-Mo alloy containing Mo of 5% by mass or more with water or gas.

On the other hand, examples of raw materials employed as the aforementioned Mo-containing compounds include: Mo oxides; Mo carbides; Mo sulfides; Mo nitrides; and compositions thereof. The Mo oxides are preferably employed in view of availability and facilitating the reductive reaction. Note that the Mo-containing compound is employed in the form of a powder, or employed so as to form a powder in the process, for example, where the Mo-containing compound is mixed with an iron-based powder and reduced. The principal component of the Mo-containing alloy powder obtained by reducing the Mo-containing compound is Mo or Mo-Fe.

In any cases, any process such as crushing or atomization may be employed for forming the Mo material in the form of a powder.

Subsequently, the aforementioned iron-based powder (a) and the Mo material powder (b) are mixed (c) in a predetermined ratio. Examples of the mixing (c) include any available method (e.g., a method using a Henschel mixer, a method using a cone mixer, and so forth). In this step, a spindle oil or the like of approximately 0.1% by mass or less (percentage based on the sum of the iron-based powder (a) and the Mo material powder (b)) may be added in order to improve adhesion between the iron-based powder (a) and the Mo material powder (b). Note that the aforementioned spindle oil or the like of 0.005% by mass or more is preferably added for the desired effect.

The compound thus prepared is subjected to heat treatment (d) in a reducing atmosphere such as a hydrogen atmosphere, hydrogen-containing atmosphere, or the like, thereby obtaining an alloy steel powder (e) in which Mo is bonded to the iron-based powder (a) in the form of a Mo-containing alloy powder by diffusion bonding. Furthermore, the alloy steel powder (e) may be subjected to heat treatment (d) in a vacuum. The heat treatment is preferably performed at a temperature equal to or greater than 800° C. and equal to or smaller than 1000° C.

Let us say that an "as atomized" iron powder containing high contents of C and O is employed as the iron-based powder (a). In this case, the heat treatment. (d) is preferably performed in a reducing atmosphere in order to reduce the contents of C and O. Furthermore, use of the "as atomized" iron powder as the iron-based powder (a) has the advantage as follows. That is to say, the contents of C and O are reduced in the diffusion bonding process, leading to activated surfaces of the iron-based powder. This enables bonding of the Mo-containing alloy (a metallic Mo may be employed) to the surfaces of the iron-based powder in a sure manner by diffusion at a relatively low temperature (800 to 900° C.), which is preferable.

Note that description will be made later regarding the preferable contents of C and O contained in the alloy steel powder, as well as other components.

It is needless to say that in a case of the process employing a Mo-containing alloy powder as the Mo raw material powder (b), the iron-based powder 1 is combined with the Mo-containing alloy powder 2 by diffusion bonding.

On the other hand, in a case of the process employing a Mo-containing compound such as a Mo oxide powder or the like as the Mo raw material powder, the Mo-containing compound is reduced into metallic Mo in the aforementioned heat treatment (d). Thus, such a process provides the alloy steel powder with a partial increase in the Mo content by diffusion bonding in the same way as the process employing a Mo-containing alloy powder as the Mo raw material powder (b).

In a case of employing the aforementioned powder obtained by atomizing Fe—Mo alloy, the heat treatment (d) may be performed for such a powder after finishing reduction. Also, an "as atomized" Fe—Mo alloy powder may be subjected to the heat treatment (d) in the same way as a case employing a Mo oxide powder or the like.

Note that a Mo-containing compound is preferably employed as compared with a Mo-containing alloy powder from the perspective of the degree of bonding thereof. The reason is that the surfaces of the Mo-containing alloy powder 2 formed by reducing in the heat treatment process becomes active with respect to diffusion reaction, thereby improving the degree of bonding thereof to the iron-based powder 1.

After the aforementioned heat treatment (d), in general, the mixture of the iron-based powder 1 and the Mo-containing alloy powder 2 forms a block due to sintering. Accordingly, such a block is crushed and classified into a powder having a desired particle diameter. Furthermore, the powder thus obtained is annealed as necessary, thereby obtaining the alloy steel powder 4.

Next, description will be made regarding the reason for limiting the content of the alloying elements in the alloy steel powder 4.

The content of Mo contained as a prealloy: 0.2 to 1.5% by mass

With the alloy steel powder 4 according to the present invention, the iron-based powder 1 contains the Mo content of 0.2 to 1.5% by mass with respect to the mass of the alloy steel powder 4, as a prealloy (i.e., contained as an alloy component beforehand). Note that an increase in the Mo content contained as a prealloy exceeding 1.5% by mass does not significantly improve the effects of quenching. On the other hand, such an increase of the Mo content exceeding 1.5% by mass leads to a problem of reduced compressibility due to hardening of the alloy steel powder 4. Furthermore, such an increase of the Mo content exceeding 1.5% by mass has the disadvantage of high costs. On the other hand, let us say that the alloy steel powder 4 is formed with the Mo content less than 0.2% by mass contained as a prealloy. Furthermore, let us say that the alloy steel powder 4 is sintered, following which the sintered body thus formed is subjected to carburizing and quenching. In this case, a ferrite phase is readily formed in the sintered body. This leads to poor strength and fatigue strength of the softened sintered body.

The content of Mn contained as a prealloy: 0.5% by mass or less

The iron-based powder 1 contains the Mn of 0.5% by mass or less with respect to the mass of the alloy steel powder 4, as a prealloy. Note that an increase of the Mn content contained as a prealloy exceeding 0.5% by mass does not significantly improve the effects of quenching. On the other hand, such an increase of the Mn content exceeding 0.5% by mass leads to a problem of reduced compressibility due to hardening of the alloy steel powder 4. Furthermore, such an increase of the Mn content exceeding 0.5% by mass leads to the disadvantage of high production costs because of excess consumption of Mn.

Note that including Mn leads to some amount of strengthening effect, and accordingly, Mn may be intentionally included within the above range. Also, the lower limit of the Mn content need not be determined in view of the material quality. Note that in many cases, the iron-based powder 1 contains Mn of 0.04% by mass as an unavoidable impurity. Formation of the iron-based powder 1 containing the reduced content of Mn less than 0.04% by mass requires a lengthy process for removing Mn, leading to high production costs. Accordingly, Mn of 0.04 to 0.5% by mass is preferably contained.

Amount of Mo Diffusion Bonding: 0.05 to 1.0% by Mass

The iron-based powder 1 contains Mo and Mn as prealloyed elements. Furthermore, a Mo-containing alloy powder is bonded to the surfaces of the iron-based powder 1 by diffusion bonding, whereby the alloy steel powder 4 is formed. With the alloy steel powder 4, the content of prealloyed Mo $[Mo]_P$ (the mass percentage based on the mass of the alloy steel powder 4) and the average Mo content $[MO]_T$ (the mass percentage based on the mass of the alloy steel powder 4) need to satisfy the following Expression (1).

$$0.05 \leqq [Mo]_T - [Mo]_P \leqq 1.0 \text{ (unit: \% by mass)} \quad (1)$$

Here, the term $[Mo]_T - [Mo]_P$ substantially represents a Mo content that is bonded on the surfaces of the iron-based powder 1 by diffusion bonding (note that there is a little amount of a Mo-containing alloy powder in the free state, which will be ignored hereafter). Note that the term $[Mo]_T - [Mo]_P$ will be referred to as "the amount of diffusion bonding" hereafter.

The amount of diffusion bonding of Mo less than 0.05% by mass leads to poor effects of quenching, as well as leading to poor effects on the enhanced sintering of the particles of the alloy steel powder 4 at the contact faces thereof. On the other hand, an increase in the amount of diffusion bonding of Mo exceeding 1.0% by mass hardly improves the effects of quenching and the effect on the enhanced sintering. Furthermore, such an excessive use of Mo leads to increased production costs. Note that the amount of diffusion bonding of Mo is preferably designed to be less than 0.5% by mass.

Note that the use of the Mo-containing alloy powder 2 with an average particle diameter of 20 μm or less significantly improves the fatigue strength of the sintered body and so forth. On the other hand, the Mo-containing alloy powder 2 is preferably employed with an average particle diameter of 1 μm or more in view of the operatability of the production process. Note that the average particle diameter of the Mo-containing alloy powder 2 is measured as follows. That is to say, the particle diameter distribution is measured with a laser diffraction scattering method stipulated by JIS R 1629 (1997 edition), and the particle diameter at a cumulative volume fraction of 50% is employed as the average particle diameter.

Furthermore, a Mo adhesion defined by the following Expression (2) is preferably 1.5 or less, and is more preferably 1.2 or less. The Mo adhesion in such a range significantly improves the fatigue strength of the sintered body and so forth.

Here, $[Mo]_S$ represents the Mo content contained in a fine alloy steel powder (which is obtained by sieving and classifying the alloy steel powder 4 to 45 μm or less in grain size with standard sieves stipulated by JIS Z 8801) in the unit of percent by mass. On the other hand, $[Mo]_T$ represents the Mo content contained in the alloy steel powder 4 (percent by mass based on the mass of the alloy steel powder 4) as already noted.

Note that in a case that the Mo-containing alloy powder is uniformly adhered to the iron-based powder, and there is no Mo-containing alloy powder in the free state, the Mo adhesion is 1. The Mo adhesion is preferably 0.9 or more, and is more preferably 1.0 or more, since the Mo-containing alloy powder preferably has small irregularity in the Mo content.

$$\text{Mo adhesion} = [Mo]_S / [Mo]_T \quad (2)$$

Addition by prealloying of the alloying elements other than the aforementioned elements such as Ni, V, Cu, Cr, and so forth to the iron-based powder leads to significantly reduced compressibility. This leads to reduced density of the sintered body, resulting in significantly reduced strength and fatigue strength thereof. Accordingly, the contents of such elements are preferably suppressed to the level of impurities. Specifically, with the iron-based powder, the contents of Ni, V, Cu, and Cr are preferably suppressed to 0.03% by mass (percent by mass with respect to the mass of the alloy steel powder) or less, 0.03% by mass or less, 0.03% by mass or less, and less than 0.02% by mass, respectively. Furthermore, the contents of Ni, V, Cu, and Cr are more preferably suppressed to 0.02% by mass or less, 0.02% by mass or less, 0.02% by mass or less, and 0.01% by mass or less, respectively.

Furthermore, of these alloying elements, the alloy steel powder as well preferably contains no alloying elements by diffusion bonding except for Ni and Cu. Accordingly, with the alloy steel powder, these elements are preferably suppressed within the aforementioned composition range.

With Ni and/or Cu blended with the mixed powder, the alloy steel powder may contain these elements by diffusion bonding. However, other addition methods are preferably employed in view of the compressibility. Accordingly, the contents of Ni and/or Cu may be suppressed in the aforementioned composition range in the alloy steel powder.

Examples of impurities contained in the iron-base powder and the alloy steel powder include: C of approximately 0.02% by mass or less; O of approximately 0.2% by mass or less; N of approximately 0.004% by mass or less; Si of approximately 0.03% by mass or less; P of approximately 0.03% by mass or less; S of approximately 0.03% by mass or less; and Al of approximately 0,03% by mass or less (note that the unit of "% by mass" represents the mass percentage based on the alloy steel powder). While lower limits of the impurities need not be determined, the industrially practiced lower limits (rough values) are described as follows: C of 0.001% by mass; 0 of 0.02% by mass; N of 0.0001% by mass; Si of 0.005% by mass; P of 0.001% by mass; S of 0.001% by mass; and Al of 0.001% by mass.

Note that in addition to those components described above, the remainder is preferably iron.

As described above, with the alloy steel powder 4, the iron-based powder 1 contains only a small amount of prealloyed elements, thereby suppressing the hardness of the alloy steel powder to a low level. This enables formation of high-density green compacts by compacting the alloy steel powder 4. Furthermore, Mo is segregated on the surfaces of the particles of the iron-based powder 1 with a high concentration (i.e., Mo-rich portion is formed). Accordingly, a single a phase is formed on the contact faces between the particles of the alloy steel powder 4 in sintering of the green compact formed of the alloy steel powder 4. This accelerates bonding between the particles of the alloy steel powder 4 by sintering.

With the Mo-rich portion according to the present invention, the portion having a Mo concentration of 2.0% by mass or more is preferably formed with an area ratio of 1% to 30% with respect to the cross-sectional area of the particle of the alloy steel powder. The reason is that the portion having a Mo concentration of 2.0% by mass or more significantly improves the effect on accelerating formation of the a phase and sintering. Furthermore, formation of such a portion with an area ratio of 1% or more significantly increases the probability that the contact portions between the particles of the alloy steel powder contains Mo with a sufficient concentration. Note that the sintering acceleration effect tends to-saturate at the Mo-high-concentration area exceeding 30%. Accordingly, the upper limit of 30% is preferably determined from the perspective of costs and for the purpose of avoiding undesired reduction of the compressibility. Furthermore, the upper limit of 20% is more preferably determined. Note that the Mo-rich portion may contain Mo of 100% by mass. On the other hand, the portion other then the Mo-rich portion substantially contains Mo equal to or greater than a prealloy concentration (minimum 0.2% by mass) and less than 2.0% by mass.

Whether or not the Mo-rich portions satisfy the aforementioned conditions can be confirmed as follows. The cross-section of the alloy steel powder particle (selected from the cross-sections having a cross-sectional diameter in a range of the average diameter ±10%) is analyzed with an EPMA, and the portion of a Mo concentration of 2.0% by mass or more is measured. The area of such a portion is calculated by image analysis, whereby the confirmation is made.

While the average particle diameter of the iron-based powder 1 according to the present invention is not restricted to a particular value, the average particle diameter is preferably in a range of 30 to 120 μm, which can be produced at low costs from the industrial perspective. Note that the average particle diameter is measured as follows. That is to say, the particle diameter distribution is measured with sieves stipulated by JIS Z 8801, and the particle diameter at a cumulative mass fraction of 50% is employed as the average particle diameter.

The average particle diameter of the alloy steel powder 4 is preferably in a range of 30 to 120 μm, as well.

A predetermined amount of a Ni powder and/or a Cu powder are added to the aforementioned alloy steel powder 4, whereby the mixed powder for powder metallurgy is prepared. Next, description will be made regarding the Ni powder and Cu powder to be added to the alloy steel powder 4. Note that each of the addition amounts (mass percentage) of the Ni powder and the Cu powder described below is represented by the rate based on 100 parts or 100 percent of the alloy steel powder 4.

Ni powder: 0.2 to 5% by mass

The Ni powder activates the sintering reaction of the alloy steel powder 4, as well as reducing the sizes of the pores in the sintered body, thereby improving the tensile strength and the fatigue strength of the sintered body. Addition of Ni less than 0.2% by mass does not provide activation of the sintering reaction. On the other hand, addition of Ni exceeding 5% by mass significantly increases retained austenite in the sintered body, leading to reduced strength of the sintered body. Accordingly, addition of the Ni powder needs to be made in a range of 0.2 to 5% by mass. Furthermore, the addition of the Ni powder is preferably made in a range of 0.5 to 3% by mass.

Note that conventional Ni powders may be employed as the aforementioned Ni powder. For example, examples of such Ni powders include a Ni powder obtained by reducing Ni oxides, a carbonyl Ni powder produced with a thermal decomposition method (carbonyl method), and so forth. Note that the aforementioned addition amount is represented in terms of metallic Ni.

Cu powder: 0.2 to 3% by mass

The Cu powder forms a liquid phase at a sintering temperature of the alloy steel powder 4, thereby accelerating the sintering reaction. Furthermore, the Cu powder makes the pores in the sintered body spherical, thereby improving the tensile strength and the fatigue strength of the sintered body. Addition of Cu less than 0.2% by mass does not improve the strength of the sintered body. On the other hand, addition of Cu exceeding 3% by mass leads to a brittle sintered body. Accordingly, addition of the Cu powder needs to be made in a range of 0.2 to 3% by mass. Furthermore, the addition of the Ni powder is preferably made in a range of 1 to 2% by mass. Note that conventional Cu powders such as an electrolytic Cu powder and an atomized Cu powder may be employed as the aforementioned Cu powder. Note that the aforementioned addition amount is represented in terms of metallic Cu.

The Ni powder alone or the Cu powder alone may be added to the alloy steel powder 4. Also, both may be added to the alloy steel powder 4. In a case of addition of the Ni powder alone or the Cu powder alone, the Ni powder is added in a range of 0.2 to 5% by mass, or the Cu powder is added in a range of 0.2 to 3% by mass. On the other hand, in a case of addition of both the Ni powder and the Cu powder, the Ni powder is added in a range of 0.2 to 5% by mass, and the Cu powder is added in a range of 0.2 to 3% by mass.

Note that addition of Ni powder having an average particle diameter of 20 μm or less and Cu powder having an average particle diameter of 30 μm or less significantly improves the fatigue strength of the sintered body and so forth. On the other hand, both average particle diameters are preferably 1.0 μm or more from the perspective of the operation of the production process. Note that the average particle may be measured in the same way as the Mo-containing alloy powder 2.

According to the present invention, the Ni powder and/or the Cu powder may be simply mixed with the alloy steel powder. Also, the Ni powder and/or the Cu powder are adhered to the alloy steel powder with a binder (binding agent). Also, following addition of the Ni powder and/or the Cu powder, heat treatment may be performed so as to adhere these powders to the alloy steel powder 4 by diffusion bonding.

Adhesion of these powders by the binder or diffusion bonding suppresses segregation of the Ni powder and the Cu powder, thereby reducing irregularities in the properties of the sintered body. Note that in some cases, the diffusion bonding leads to reduced compressibility as described above. Accordingly, adhesion using a binder is most preferably employed.

The binder used here is not restricted to a particular material.

Rather, conventionally-known binders may be employed. Examples of such binders include: metallic soap such as zinc stearate, calcium stearate, and so forth; amide wax such as ethylene-bis-stearamide, mono-stearamide, and so forth. In particular, each of the aforementioned binders also has a lubricant function, and accordingly, such a binder is preferably employed. Also, binders having a relatively poor lubricant function may be applied. Examples of such binders include PVA (polyvinyl alcohol), vinyl-ethylene acetate copolymer, and phenol resin. Note that the term lubricant function as used here represents functions in compacting, and specifically, a function for improving the density of the green compact due to acceleration of rearrangement of the powder, and a function for improving ejectability.

With such binders, the Ni powder or the Cu powder is adhered to the surfaces of the particles of the iron-based powder by heating and melting at a melting point (including the eutectic point) of the binder or more. Note that adhesion using the binder is not restricted to the aforementioned method. For example, adhesion may be made as follows. That is to say, the binder component is dissolved in a solvent, and the solution is applied to the iron-based powder and the Mo-containing alloy powder so as to adhere both powders to each other. Subsequently, the solvent is evaporated, whereby the adhesion is made. In a case of adhesion using a binder selected from the aforementioned binders such as metallic soap, after addition of the binder having a melting point of around 80 to 150° C., adhesion of the Ni powder and the Cu powder is preferably made by heating up to a temperature equal to or greater than the aforementioned melting point.

Note that it has been confirmed that the Ni content as a prealloy hardly reduces the sizes of the pores in the sintered body. Accordingly, Ni needs to be added by mixing or the like.

Making comparison between the effects of addition of the Ni powder and the Cu powder, the addition of the Ni powder more significantly improves the bending fatigue strength and so forth.

It is believed that the effects of addition of the Ni powder and the Cu powder, and the effects of the addition method are caused by actions of the following mechanism.

With the rolling contact fatigue strength, the compressive stress is principally applied, and accordingly, it is most important to form the sintered body with a high density. On the other hand, with the rotating bending fatigue strength, the tensile stress is applied as well as the compressive stress, and accordingly, the sizes and the shapes of the pores remaining in the sintered body are not ignored and affect the rotating bending fatigue strength. Accordingly, it is believed that addition of the Ni powder and the Cu powder improves the shape of the pores, thereby significantly improving the rotating bending fatigue strength.

Note that it is believed that the Ni content and the Cu content thus added improve the shape of the pores in a later period of the sintering in which most of the pores are formed. Accordingly, the significant synergistic effects are obtained by a combination of: addition of Mo as a prealloy and by diffusion bonding for accelerating reduction in the sizes of the pores; and addition of Ni or Cu by simple mixture or using a binder so as to diffuse around the pores mainly in the later period of the sintering.

Next, description will be made regarding the preferable conditions for producing a sintering body using the mixed powder for powder metallurgy according to the present invention.

Prior to compacting of the mixed powder, a carbon-containing powder such as a graphite powder is preferably mixed as an alloy powder with a concentration of around 0.1 to 1.2 parts by mass (value based on 100 parts by mass of the mixed powder). Furthermore, a known powder for improving machinability (MnS or the like) may be added. Note that both the carbon-containing powder and the powder for improving machinability are preferably adhered to the alloy steel powder using a binder.

Furthermore, prior to compacting, a powdery lubricant may be mixed with the alloy steel powder. Furthermore, or alternatively, a lubricant may be applied or adhered on the surface of a die. For these purposes, known lubricants are preferably employed for reducing the friction between the particles in compacting, and the friction between the particles and the die. Examples of such lubricants include: metallic soaps (e.g., zinc stearate, lithium stearate, calcium stearate, and so forth); and fatty acid amide (e.g., stearamide, ethylene-bis-stearamide, erucic amide, and so forth).

In a case of mixing of such a lubricant, the lubricant is preferably mixed with the alloy steel powder with a concentration of around 0.1 to 1.2 parts by mass (value based on 100 parts by mass of the mixed powder).

Also, at the time of mixing of the mixed alloy steel powder with such a lubricant, the alloy steel powder may be heated so that the Ni powder and the Cu powder are adhered thereto with the lubricant as a binder.

The compaction is preferably performed at a pressure of around 400 to 1000 MPa and at a temperature from room temperature (approximately 20° C.) to approximately 160° C. Note that any known compacting method may be employed. For example, a compacting method may be employed in which the die is heated to a temperature of 50 to 70° C. while maintaining the iron-based mixed powder at room temperature. Such a compacting method is preferably employed since the powder can be handled with ease, and the density of the green compact of the iron-based powder (density of the green compact) is further improved. Also, a compacting method, i.e., a warm forming method may be employed in which both the powder and the die are heated to a temperature of 120 to 130° C.

Sintering is preferably performed at a temperature of around 1100 to 1300° C. In particular, sintering is preferably performed at a temperature of 1160° C. or less using a mesh belt furnace, which is inexpensive and suitable for mass-production, from the economic perspective. Furthermore, the sintering is more preferably performed at a temperature of 1140° C. or less. On the other hand, a sintering time of around 10 to 60 minutes is-preferably employed. Also, other furnaces such as a tray pusher-type sintering furnace or the like may be used.

The resultant sintered body may be subjected to a strengthening treatment such as carburizing and quenching (CQT), bright-quenching (BQT), high-frequency quenching, or carbonitriding treatment according to needs. Tempering may be further performed after quenching or the like. The strengthening treatment conditions may be determined according to known methods. Even if such a strengthening treatment is not performed, the bending fatigue strength of the sintered body and so forth are improved as compared with that of a conventional sintered body (without such a strengthening treatment).

Note that the sizes of the pores contained in the sintered body are also affected by the compacting conditions and sintering conditions. Let us say that a Ni powder is added, for example. In this case, the process in which compacting is performed with a pressing density of 7.1 to 7.4 $Mg/m^3$ and sintering is performed at a temperature of 1100 to 1160° C. for a period of 10 minutes to 60 minutes leads to a sintered body having the average pore diameter of 5 to 20 μm. On the other hand, the process in which compacting is performed with a pressing density of 7.4 $Mg/m^3$ or more and sintering is performed at a temperature of 1130° C. or more for a period of 20 minutes or more leads to a sintered body having the average pore diameter of 10 μm or less.

Note that from the perspective of the tensile strength and the fatigue strength, the components of the resultant sintered body are preferably adjusted by controlling the amount of the carbon-containing powder to be mixed and the conditions of the strengthening process, as follows: C of 0.6 to 1.2% by mass; 0 of 0.02 to 0.15% by mass; and N of 0.001 to 0.7% by mass.

EXAMPLES

Detailed description will be made regarding the present invention below with reference to examples. An alloy powder for powder metallurgy according to the present invention and the use thereof is not restricted to the following examples.

Example 1

Molten steel containing predetermined amounts of Mo and Mn was atomized by water atomization to produce an iron-based as-atomized powder (average particle diameter: 70 to 90 μm). A $MoO_3$ powder (average particle diameter: 1 to 3 μm) was added to this iron-based powder as a raw Mo powder in a predetermined ratio, and then mixed using a V-type mixer for 15 minutes.

The mixed powder was heated in a hydrogen atmosphere having a dew point of 30° C. (keeping temperature: 875° C., keeping time: 1 hour). Thus, the $MoO_3$ powder was reduced to Mo metal powder and the resultant Mo powder was bonded to the surfaces of an iron-based powder by diffusion bonding to produce alloy steel powders for powder metallurgy. All of the alloy steel powders for powder metallurgy had an average particle diameter of 70 to 90 μm. Subsequently, a Ni powder (carbonyl Ni powder) having an average particle diameter of 4 μm and a Cu powder (electrolytic Cu powder) having an average particle diameter of 20 μm were added to these alloy steel powders, and then mixed using a V-type mixer for 15 minutes, thereby forming mixed powders for powder metallurgy. Table 1 shows the compositions of the mixed powders for powder metallurgy thus obtained. The remainder other than the compositions shown in Table 1 substantially consists of iron and impurities.

TABLE 1

| | Mixed powder for powder metallurgy | | | | | |
|---|---|---|---|---|---|---|
| | Alloy steel powder | | | | | |
| | Iron-based powder | | Amount of Mo | | | |
| Sample No. | Prealloyed Mn content (mass percent) | prealloyed Mo content (mass percent) | diffusion bonding (mass percent) | Ni powder (*) (mass percent) | Cu powder (*) (mass percent) | Remark |
| 1 | 0.21 | 0.62 | 0.0 | 1.0 | — | Comparative Example |
| 2 | 0.21 | 0.62 | 0.2 | 1.0 | — | Example |
| 3 | 0.21 | 0.62 | 0.6 | 1.0 | — | |
| 4 | 0.21 | 0.62 | 0.8 | 1.0 | — | |
| 5 | 0.21 | 0.62 | 1.2 | 1.0 | — | Comparative |
| 6 | 0.19 | 0.12 | 0.4 | 0.5 | 2.0 | Example |
| 7 | 0.21 | 0.62 | 0.4 | 0.5 | 2.0 | Example |
| 8 | 0.21 | 1.03 | 0.4 | 0.5 | 2.0 | |
| 9 | 0.20 | 1.45 | 0.4 | 0.5 | 2.0 | |
| 10 | 0.19 | 1.79 | 0.4 | 0.5 | 2.0 | Comparative |
| 11 | 0.56 | 0.59 | 0.4 | 0.5 | 2.0 | Example |
| 12 | 0.20 | 0.81 | 0.2 | 0.1 | — | |
| 13 | 0.20 | 0.81 | 0.2 | 0.5 | — | Example |
| 14 | 0.20 | 0.81 | 0.2 | 1.0 | — | |
| 15 | 0.20 | 0.81 | 0.2 | 4.0 | — | |
| 16 | 0.21 | 0.62 | 0.6 | — | 0.1 | Comparative Example |
| 17 | 0.21 | 0.62 | 0.6 | — | 0.5 | Example |
| 18 | 0.21 | 0.62 | 0.6 | — | 1.0 | |
| 19 | 0.21 | 0.62 | 0.6 | — | 2.0 | |

TABLE 1-continued

| | Mixed powder for powder metallurgy | | | | | |
|---|---|---|---|---|---|---|
| | Alloy steel powder | | | | | |
| | Iron-based powder | | Amount of Mo | | | |
| Sample No. | Prealloyed Mn content (mass percent) | prealloyed Mo content (mass percent) | diffusion bonding (mass percent) | Ni powder (*) (mass percent) | Cu powder (*) (mass percent) | Remark |
| 20 | 0.21 | 0.62 | 0.6 | — | 4.0 | Comparative Example |
| 21 | 0.10 | 0.60 | 0.2 | 1.0 | — | Example |
| 22 | 0.40 | 0.60 | 0.2 | 1.0 | — | |
| 23 | 0.20 | 0.40 | 0.2 | 1.0 | — | |
| 24 | 0.21 | 0.62 | 0.1 | 1.0 | — | |
| 25 | 0.21 | 0.62 | 0.4 | 1.0 | — | |

(*) Symbol "—" represents that the material was not added.

In Table 1, Sample Nos. 2 through 4, and 13 through 15 are examples in which the prealloyed Mo content, the prealloyed Mn content, the amount of Mo diffusion bonding, and the Ni powder addition amount satisfy the range of the present invention. Sample Nos. 1 and 5 are examples in which the amount of Mo diffusion bonding is not within the range of the present invention.

Sample Nos. 7 through 9 are examples in which the prealloyed Mo content, the prealloyed Mn content, the amount of Mo diffusion bonding, the Ni powder addition amount, and the Cu powder addition amount satisfy the range of the present invention. Sample Nos. 6 and 10 are examples in which the amount of prealloyed Mo content is not within the range of the present invention. Sample No. 11 is an example in which the prealloyed Mn content is not within the range of the present invention.

Sample No. 12 is an example in which the Ni powder addition amount is not within the range of the present invention.

Sample Nos. 17 through 19 are examples in which the prealloyed Mo content, the prealloyed Mn content, the amount of Mo diffusion bonding, and the Cu powder addition amount satisfy the range of the present invention. Sample Nos. 16 and 20 are examples in which the Cu powder addition amount is not within the range of the present invention.

Furthermore, a graphite powder of 0.3 parts by mass serving as an alloying powder and lithium stearate of 0.8 parts by mass serving as a lubricant were added to these mixed powders for powder metallurgy of 100 parts by mass, and then mixed using a V-type mixer for 15 minutes. Next, the mixed powders for powder metallurgy were heated to a temperature of 130° C. and filled in the die (temperature: 130 ° C.). Furthermore, the mixture was compacted (pressure: 686 MPa).

The green compact is sintered (sintering temperature: 1130° C., sintering time: 20 minutes) in an RX-gas atmosphere ($CO_2$ atmosphere containing $H_2$ of 32% by volume, CO of 24% by volume, $CO_2$ of 0.3% by volume, and reminder being $N_2$) to form a sintered body. The resultant sintered body was subjected to gas carburizing (temperature: 870° C., time: 60 minutes) in a carbon potential of 0.8% by mass. Subsequently, the sintered body was quenched (quenching temperature: 60° C., oil quenching) and tempered (temper temperature: 200° C., temper time: 60 minutes). Note that the carbon potential represents the carburizing potential of the atmosphere in which steel is heated. More specifically, the carbon potential is represented by the concentration of carbon on the surface of the steel in the gas atmosphere in the equilibrium state at the temperature.

The density, the tensile strength, and the rotating bending fatigue strength of the sintered body were measured. The results are shown in Table 2. The density was measured according to a method stipulated by JIS Z 2501. The tensile strength was measured with a tensile test at room temperature with regard to a small and round rod sample with a parallel part having diameter of 5 mm and length of 15 mm extracted from the sintered body. The rotating bending fatigue strength was measured as follows. First, a smooth and round rod sample with a parallel part having diameter of 8 mm and length of 15.4 mm was extracted from the sintered body. Then, the maximum load in which the sample was not destroyed after $10^7$ times tests was obtained using an Ono-type rotating bending fatigue tester. The maximum load is employed as the rotating bending fatigue strength of the sintered body.

TABLE 2

| | Sintered body | | | |
|---|---|---|---|---|
| Sample No. | Density ($Mg/m^3$) | Tensile strength (MPa) | Rotating bending fatigue strength (MPa) | Remark |
| 1 | 7.30 | 1200 | 310 | Comparative Example |
| 2 | 7.32 | 1450 | 430 | Example |
| 3 | 7.33 | 1510 | 450 | |
| 4 | 7.34 | 1440 | 430 | |
| 5 | 7.34 | 1210 | 320 | Comparative |
| 6 | 7.29 | 1270 | 340 | Example |
| 7 | 7.29 | 1390 | 390 | Example |
| 8 | 7.28 | 1350 | 380 | |
| 9 | 7.26 | 1320 | 370 | |
| 10 | 7.19 | 1190 | 300 | Comparative |
| 11 | 7.16 | 1120 | 280 | Example |
| 12 | 7.29 | 1250 | 320 | |
| 13 | 7.30 | 1340 | 430 | Example |
| 14 | 7.31 | 1480 | 450 | |
| 15 | 7.32 | 1490 | 440 | |
| 16 | 7.31 | 1170 | 310 | Comparative Example |
| 17 | 7.32 | 1310 | 360 | Example |
| 18 | 7.31 | 1360 | 390 | |
| 19 | 7.30 | 1350 | 380 | |
| 20 | 7.28 | 1100 | 280 | Comparative Example |
| 21 | 7.34 | 1470 | 460 | Example |
| 22 | 7.24 | 1340 | 360 | |
| 23 | 7.35 | 1450 | 440 | |

TABLE 2-continued

| Sample No. | Sintered body Density ($Mg/m^3$) | Tensile strength (MPa) | Rotating bending fatigue strength (MPa) | Remark |
|---|---|---|---|---|
| 24 | 7.31 | 1420 | 410 | |
| 25 | 7.32 | 1460 | 440 | |

As can be clearly understood from Table 2, making a comparison among Sample Nos. 1 through 5 of Examples (Sample No. 2 through 4) and Comparative Example (Sample Nos. 1 and 5), while there is no difference in the density therebetween, the Examples are superior to the Comparative Examples with regard to the tensile strength and the fatigue strength.

On the other hand, making a comparison between Sample Nos. 6 through 11 of Examples (Sample No. 7 through 9) and Comparative Example (Sample Nos. 6, 10, and 11), the Examples are superior to the Comparative Examples with regard to all of the density, the tensile strength, and the rotating bending fatigue strength.

Making a comparison between Sample Nos. 12 through 15 of Examples (Sample Nos. 13 through 15) and Comparative Example (Sample No. 12), while there is no difference in the density therebetween, the Examples are superior to the Comparative Example with regard to the tensile strength and the rotating bending fatigue strength.

Making a comparison between Sample Nos. 16 through 20 of Examples (Sample No. 17 and 19) and Comparative Examples (Sample Nos. 16 and 20), while there is no difference in the density therebetween, the Examples are superior to the Comparative Examples with regard to the tensile strength and the rotating bending fatigue strength.

Example 2

Alloy steel powders were formed in the same way as with the embodiment 1, in which predetermined amounts of Mo (by Mo metallic powder, Fe containing Mo of 10% by mass, and Fe containing Mo of 50% by mass) were adhered to the surfaces of an iron base powder containing predetermined amounts of the Mo content and Mn content as prealloyed elements by diffusion bonding. Furthermore, the alloy steel powder was mixed with a predetermined amount of a Ni powder of an average particle diameter of 4 μm, a graphite powder of 0.3% by mass, and ethylene-bis-stearamide of 0.6% by mass serving as a lubricant and a binder, while heating at a temperature 160° C. for 10 minutes, whereby the Ni powder was adhered to the surfaces of the alloy steel powder (Sample Nos. 26, 29, and 30). Note that with Sample No. 31, the mixed powder was formed in the same way except for the point that the Ni powder was added and then mixed after the step in which addition of the binder, heating, and mixing was performed. Furthermore, with Sample No. 32 and Sample No. 33 which is a comparative example for the composition were high-temperature sintered (at 1250° C. for 60 minutes in a $N_2$ atmosphere containing 10% $H_2$ by volume).

Also, an alloy steel powder was formed in which the Ni powder was adhered to the surfaces of an iron-based powder by diffusion bonding (Sample No. 27). Furthermore, as an comparative example, an alloy steel powder was formed in which a predetermined amount of Mo was adhered to the surfaces of the iron-based powder containing Ni as well as predetermined amounts of Mo and Mn as prealloyed elements by diffusion bonding (Sample No. 28). These alloy steel powders were heated and mixed with a graphite powder of 0.3% by mass and ethylene-bis-stearamide of 0.6% by mass serving as a lubricant and a binder at a temperature of 160° C. for 10 minutes.

These mixed powders were subjected to compaction, sintering, and carburizing in the same way as with the Example 1. Subsequently, the density, the tensile strength, the rotating bending fatigue strength, and the average pore diameter were measured with regard to these sintered bodies. The measurement results are shown in Tables 3 and 4. Note that the average pore diameter was measured as follows. First, the cross-section of the sintered body was subjected to mirror-face polishing, and an image of the cross-section was acquired using an optical microscope having a field-of-view of 50 $cm^2$. The average pore diameter was obtained by analyzing the image using circle approximation.

TABLE 3

| Sample No. | Alloy steel powder: Iron-based powder: Prealloyed Mn content (mass percent) | Prealloyed Mo content (mass percent) | Prealloyed Ni content (mass percent) | Diffusion bonding: Amount of Mo diffusion bonding (mass percent) | Amount of Ni diffusion bonding (*4) (mass percent) | Additional content Ni powder (*4) (mass percent) | Remark |
|---|---|---|---|---|---|---|---|
| 26 | 0.19 | 0.60 | — | 0.15 | — | 1 | Example |
| 27 | 0.19 | 0.60 | — | 0.15 | 1 | — | |
| 28 | 0.19 | 0.60 | 1.00 | 0.15 | — | — | Comparative Example |
| 29*1 | 0.19 | 0.60 | — | 0.15*3 | — | 1 | Example |
| 30*2 | 0.19 | 0.60 | — | 0.15*3 | — | 1 | |
| 31 | 0.19 | 0.60 | — | 0.15 | — | 1*5 | |
| 32*6 | 0.19 | 0.60 | — | 0.15 | — | 1 | |
| 33*6 | 0.19 | 0.60 | — | 0.15 | — | — | Comparative Example |

*1Powder containing Fe and 10% by mass of Mo was used as an Mo source.
*2Powder containing Fe and 50% by mass of Mo was used as an Mo source.
*3Value converted into the amount of metallic Mo
(*4) Symbol "—" represents that the material was not added.
*5Without binder
*6Sintering condition: at 1250° C. for 60 minutes

TABLE 4

| Sample No. | Density of sintered body ($Mg/m^3$) | Tensile strength (MPa) | Rotating bending fatigue strength (MPa) | Average pore diameter (μm) | Remark |
|---|---|---|---|---|---|
| 26 | 7.35 | 1460 | 490 | 10.1 | Example |
| 27 | 7.32 | 1410 | 450 | 10.8 | |
| 28 | 7.25 | 1220 | 310 | 13.6 | Comparative Example |
| 29 | 7.35 | 1450 | 480 | 10.5 | Example |
| 30 | 7.37 | 1455 | 487 | 10.3 | |
| 31 | 7.34 | 1440 | 470 | 10.2 | |
| 32 | 7.43 | 1510 | 500 | 8.0 | |
| 33 | 7.35 | 1280 | 350 | 11.4 | Comparative Example |

Making a comparison of the Example Sample Nos. 26, 27, 29 and 30 with the Comparative Example Sample No. 28, the sintered body of the Example had pores with a smaller average pore diameter than the Comparative Example, and was superior to the Comparative example with regard to the tensile strength and the rotating bending fatigue strength. On the other hand, with regard to the Ni powder, the samples (Sample Nos. 26, 29, and 30) in which the Ni powder was adhered to the alloy steel powder with a binder had pores with a smaller pore diameter than the sample (Sample No. 27) in which the Ni powder was adhered by diffusion bonding, thereby improving the rotating bending fatigue strength thereof.

Example 3

An iron-based powder containing predetermined amounts of Mo and Mn contents as prealloyed elements were mixed with a predetermined amount of a Mo raw material powder ($MoO_3$ powder) in the same way as with the Example 1. The mixed powder was subjected to heat treatment at a temperature (900 to 1050° C.) different from that of Example 1 in a hydrogen atmosphere at a dew point of 30° C., whereby alloy steel powders were formed as indicated by Sample Nos. 34 through 36 in Table 5. Note that Table 5 also shows Sample Nos. 1 through 5 of the alloy steel powders according to the Example 1.

The area ratio of the region having a Mo concentration of 2.0% by mass or more was measured as follows. The alloy steel powder embedded in resin was polished, and ten particle cross-sections were selected (with a cross-sectional diameter within a range of the average particle diameter ±10%). The ten particle cross-sections were analyzed with an EPMA, and the regions having a Mo concentration of 2.0% by mass or more were measured, whereby the area thereof was calculated by image analysis. The values (ten values) calculated for these cross-sections were averaged, whereby the area ratio of the region having a Mo concentration of 2.0% by mass or more was. obtained.

The alloy steel powders shown in Table 5 were mixed with a Ni powder of 1.0% by mass, and sintered bodies were obtained in the same way as with the Example 1. Then, the density, the tensile strength, and the rotating bending fatigue strength were measured. The measurement results are shown in Table 6.

TABLE 5

| | Alloy steel powder | | | | | |
|---|---|---|---|---|---|---|
| | iron-based powder | | Amount of | | Area ratio of | |
| Sample No. | Prealloyed Mn content (mass percent) | Prealloyed Mo content (mass percent) | Mo diffusion bonding (mass percent) | Temperature in diffusion bonding (° C.) | region having Mo concentration of 2.0 mass percent or more (%) | Remark |
| 1 | 0.21 | 0.62 | 0.0 | 875 | 0 | Comparative Example |
| 2 | 0.21 | 0.62 | 0.2 | 875 | 3 | Example |
| 3 | 0.21 | 0.62 | 0.6 | 875 | 10 | |
| 4 | 0.21 | 0.62 | 0.8 | 875 | 16 | |
| 5 | 0.21 | 0.62 | 1.2 | 875 | 32 | Comparative Example |
| 34 | 0.19 | 0.12 | 0.4 | 900 | 4.0 | Example |
| 35 | 0.21 | 0.62 | 0.4 | 950 | 2.0 | |
| 36 | 0.21 | 1.03 | 0.4 | 1000 | 1.0 | |

TABLE 6

| | Sintered body | | | |
|---|---|---|---|---|
| Sample No. | Density ($Mg/m^3$) | Tensile strength (MPa) | Rotating bending fatigue strength (MPa) | Remark |
| 1 | 7.30 | 1200 | 310 | Comparative Example |
| 2 | 7.32 | 1450 | 430 | Example |
| 3 | 7.33 | 1510 | 450 | |
| 4 | 7.34 | 1440 | 430 | |
| 5 | 7.34 | 1210 | 320 | Comparative Example |
| 34 | 7.31 | 1450 | 480 | Example |
| 35 | 7.29 | 1400 | 450 | |
| 36 | 7.27 | 1380 | 430 | |

As can be clearly understood from Tables 5 and 6, making a comparison of Examples (Nos. 2 through 4, and Nos. 34 through 36), which have an area ratio of the region having a Mo concentration of 2.0% or more by mass of 1 to 30%, with Comparative Examples (Nos. 1 and 5), the Examples were superior to the Comparison Examples with regard to the tensile strength and the rotating bending fatigue strength.

INDUSTRIAL APPLICABILITY

Use of a mixed powder for powder metallurgy according to the present invention enables production of a sintered body having a high density as well as superior tensile strength and rotating bending fatigue strength without special sintering process.

The invention claimed is:

1. A mixed powder for powder metallurgy comprising an alloy steel powder having: an iron-based powder containing Mn of 0.5% by mass or less and Mo of 0.2 to 1.5% by mass as prealloyed elements, wherein the iron-based powder containing Ni in an amount of 0.03% by mass or less; and Mo of 0.05 to 1.0% by mass adhered to the surfaces of said iron-based powder in the form of a powder by diffusion bonding, and a blended powder which is at least one of a Ni powder of 0.2 to 5% by mass and a Cu powder of 0.2 to 3% by mass.

2. A mixed powder for powder metallurgy comprising an alloy steel powder and a blended powder which is at least one of a Ni powder of 0.2 to 5% by mass and a Cu powder of 0.2 to 3% by mass, wherein said alloy steel powder has an area on the surfaces thereof, which has a Mo concentration of 2.0% or more by mass, in a range equal to or greater than 1% and equal to or less than 30% of the cross-sectional area thereof, and wherein the remainder of said alloy steel powder contains Mo with a concentration equal to or greater than 0.2% by mass and less than 2.0% by mass, and wherein the alloy powder contains 0.03% by mass or less of Ni.

3. A mixed powder for powder metallurgy according to claim 1, wherein said alloy steel powder includes at least one of said Ni powder and said Cu powder adhered to the surfaces thereof by a binder.

4. A mixed powder for powder metallurgy according to claim 2, wherein said alloy steel powder includes at least one of said Ni powder and said Cu powder adhered to the surfaces thereof by a binder.

5. A mixed powder for powder metallurgy according to claim 1, wherein the iron-based powder further contains 0.03 mass % or less of V,0.03 mass % or less of Cu and 0.02 mass % or less of Cr.

6. A mixed powder for powder metallurgy according to claim 2, wherein the alloy steel powder further contains 0.03 mass % or less of V, 0.03 mass % or less of Cu and 0.02 mass % or less of Cr.

7. A mixed powder for powder metallurgy according to claim 1, wherein the iron-based powder further contains 0.02 mass % or less of Ni, 0.02 mass % or less of V, 0.02 mass % or less of Cu and 0.01 mass % or less of Cr.

8. A mixed powder for powder metallurgy according to claim 2, wherein the alloy steel powder further contains 0.02 mass % or less of Ni, 0.02 mass % or less of V, 0.02 mass % or less of Cu and 0.01 mass % or less of Cr.

9. A mixed powder for powder metallurgy according to claim 1, wherein the alloy steel powder further contains 0.03 mass % or less of Ni, 0.03 mass % or less of V, 0.03 mass % or less of Cu and 0.02 mass % or less of Cr.

* * * * *

UNITED STATES PATENT AND TRADEMARK OFFICE

CERTIFICATE OF CORRECTION

PATENT NO. : 7,384,446 B2
APPLICATION NO. : 10/560080
DATED : June 10, 2008
INVENTOR(S) : Unami et al.

It is certified that error appears in the above-identified patent and that said Letters Patent is hereby corrected as shown below:

On the Title Page, Item

[*] Notice: Subject to any disclaimer, the term of this patent is extended or adjusted under 35 USC 154(b) by 71 days Delete the phrase "by 71 days" and insert --by 190 days--

Signed and Sealed this

Eleventh Day of November, 2008

JON W. DUDAS
*Director of the United States Patent and Trademark Office*